US006486407B1

(12) United States Patent
Hawker et al.

(10) Patent No.: US 6,486,407 B1
(45) Date of Patent: Nov. 26, 2002

(54) POWER STRIP WITH ADJUSTABLE OUTLETS

(75) Inventors: Christopher L. Hawker, Columbus, OH (US); Steven A. Sauer, Columbus, OH (US)

(73) Assignee: Trident Design LLC, Columbus, OH (US)

( * ) Notice: Subject to any disclaimer, the term of this patent is extended or adjusted under 35 U.S.C. 154(b) by 0 days.

(21) Appl. No.: 09/881,525

(22) Filed: Jun. 14, 2001

(51) Int. Cl.[7] ..... H01B 17/00; H01R 9/11

(52) U.S. Cl. ..... 174/149 B; 174/72 R; 439/623

(58) Field of Search ..... 174/70 B, 70 C, 174/71 B, 71 R, 72 R, 149 B, 149 R; 439/214, 52, 502, 623; 200/51.05, 51.06

(56) References Cited

U.S. PATENT DOCUMENTS

| | | | | | |
|---|---|---|---|---|---|
| 2,385,165 | A | * | 9/1945 | Sears | 200/51.06 |
| 4,083,621 | A | | 4/1978 | Davidson et al. | 339/119 |
| 4,500,150 | A | | 2/1985 | Leibensperger et al. | 339/28 |
| 4,739,129 | A | * | 4/1988 | Owen et al. | 200/51.04 |
| 4,867,701 | A | * | 9/1989 | Wiand | 439/501 |
| 4,971,576 | A | | 11/1990 | Thimmesch | 439/502 |
| 5,115,105 | A | * | 5/1992 | Gallusser et al. | 174/71 R |
| 5,168,124 | A | * | 12/1992 | Takase et al. | 174/72 A |
| 5,183,971 | A | * | 2/1993 | Lafosse et al. | 174/71 B |
| 5,194,692 | A | * | 3/1993 | Gallusser et al. | 174/71 R |
| 5,234,360 | A | * | 8/1993 | Kramer | 439/505 |
| 5,236,374 | A | | 8/1993 | Leonard et al. | 439/505 |
| 5,243,136 | A | * | 9/1993 | Chen | 174/72 C |
| 5,306,870 | A | * | 4/1994 | Abat | 174/71 R |
| 5,319,356 | A | * | 6/1994 | Yoshino | 174/68.2 |
| 5,368,490 | A | * | 11/1994 | McKissick | 439/52 |
| D362,229 | S | | 9/1995 | Moses | D13/142 |
| 5,510,960 | A | * | 4/1996 | Rosen | 361/624 |
| D379,086 | S | | 5/1997 | Sipes | D13/142 |
| D383,726 | S | | 9/1997 | Nelson | D13/142 |
| 5,902,148 | A | | 5/1999 | O'Rourke | 439/505 |
| 5,912,807 | A | * | 6/1999 | Gallagher et al. | 174/71 R |
| 5,937,950 | A | * | 8/1999 | Adams et al. | 174/72 R |
| 5,967,820 | A | * | 10/1999 | Siegal et al. | 439/214 |
| 6,045,399 | A | * | 4/2000 | Yu | 439/214 |
| 6,086,397 | A | * | 7/2000 | Chapman et al. | 439/214 |
| 6,106,328 | A | * | 8/2000 | O'Neal | 439/503 |
| 6,210,189 | B1 | * | 4/2001 | Gantt | 439/214 |

* cited by examiner

*Primary Examiner*—Dean A. Reichard
*Assistant Examiner*—Adolfo Nino
(74) *Attorney, Agent, or Firm*—Standley & Gilcrest LLP

(57) ABSTRACT

An electricity distribution system such as a power strip that has adjustable outlets. The adjustable outlets have no fixed position within a housing. The power strip comprises a power cord/cable that is adapted to receive an input of electricity. One end of the power cord/cable may be terminated with an electrical connector. The opposite end of the power cord/cable is connected to a bus system which may be mounted inside of a housing. The system further includes at least one other power cord/cable that is connected to the bus system. As a result, each additional power cord/cable is adapted to be in electrical communication with the power cord/cable that is adapted to receive the input of electricity. Each of the additional power cord(s)/cable(s) may also be terminated with an electrical connector. In this manner, the present invention may provide at least one adjustable power outlet.

21 Claims, 6 Drawing Sheets

POWER STRIP WITH ADJUSTABLE OUTLETS

BACKGROUND AND SUMMARY OF THE INVENTION

The present invention relates generally to an electricity distribution system and, more particularly, to an electrical strip such as a power strip. The present invention will be described primarily with regard to a power strip. However, the present invention may also be implemented in other types of electricity distribution systems such as for data transmission, address transmission, control signal transmission, response signal transmission, timing signal transmission, and other suitable uses.

Power strips are commonly used to distribute a power input to multiple outlets, i.e., jacks, sockets, or female connectors. An example of a typical power strip is comprised of a power cord having one end that is fitted with electrical plug, i.e., male connector, and another end that is connected to a plastic housing having a fixed shape. A plurality of outlets, e.g., five outlets, are positioned a fixed (and typically close) distance apart on a surface of the plastic housing. The power cord is connected to each of the outlets. As a result, power can be supplied to each of the outlets by inserting the electrical plug into a source of electricity, e.g., an 120 VAC outlet.

Power strips are commonly used in households, work environments, and in various other types of environments. In particular, power strips are useful when there are not enough built-in power outlets nearby to support all of the devices and equipment that need power. For example, power strips are commonly used in households to supply power to items such as televisions, stereos, compact disk (CD) players, lights, lamps, cable boxes, computers, computer monitors, computer printers, alarm clocks, sweepers, and other various types of household items.

Known power strips, however, have shortcomings which limit their effectiveness. As noted above, the outlets of known power strips are mounted a fixed distance apart in the plastic housing. This can lead to some different problems. First of all, the outlets may be positioned too closely together such that they cannot simultaneously reach all of the items that need power. The outlets may also be positioned too closely together such that electrical plugs cannot be simultaneously positioned in adjacent outlets. This occurs because plugs come in a large variety of shapes and sizes. As a result, bulky plugs and plugs that have a certain shape or orientation may prevent another plug from being inserted into an adjacent outlet of the power strip. Furthermore, even if it is possible to simultaneously position a plug in each of the outlets, it may be difficult to grasp and remove one of the plugs if the outlets are positioned too closely together. Accordingly, a need exists for an improved electricity distribution system that overcomes some or all of the aforementioned shortcomings.

The present invention provides an electricity distribution system that has adjustable outlets. The outlets can be moved in any direction with respect to each other and/or the housing to provide more convenient access to the outlets. One exemplary embodiment of the present invention is a power strip that has adjustable outlets. For example, a power cord or cable is provided that is adapted to receive an input of electricity. One end of the power cord or cable may be terminated with an electrical connector for receiving the input of electricity. The opposite end of the power cord or cable is connected to a bus system which may be mounted inside of a housing. The system further includes at least one other power cord or cable that is connected to the bus system. As a result, each additional power cord or cable is adapted to be in electrical communication with the power cord that is adapted to receive the input of electricity. Each of the additional power cord(s) or cable(s) may be terminated with an electrical connector. In this manner, the present invention may provide at least one adjustable power outlet.

In addition to the novel features and advantages mentioned above, other objects and advantages of the present invention will be readily apparent from the following descriptions of the drawings and exemplary embodiments.

DETAILED DESCRIPTION OF EXEMPLARY EMBODIMENT(S)

The present invention is directed to an electrical distribution system that preferably has adjustable outlets that have no fixed position within a housing. As a result, a user can preferably adjust the respective position of each of the outlets, thereby adapting the electrical distribution system to the environment in which it is to be used. Nevertheless, certain embodiments of the present invention may not have adjustable outlets. Examples of electrical distribution systems include, but are not limited to, power strips, data transmission systems, address transmission systems, control signal transmission systems, response signal transmission systems, and timing signal transmissions. In addition, the present invention may also be implemented in other types of electrical distribution systems where it is desired to distribute electricity to at least one other location.

Figure 1:
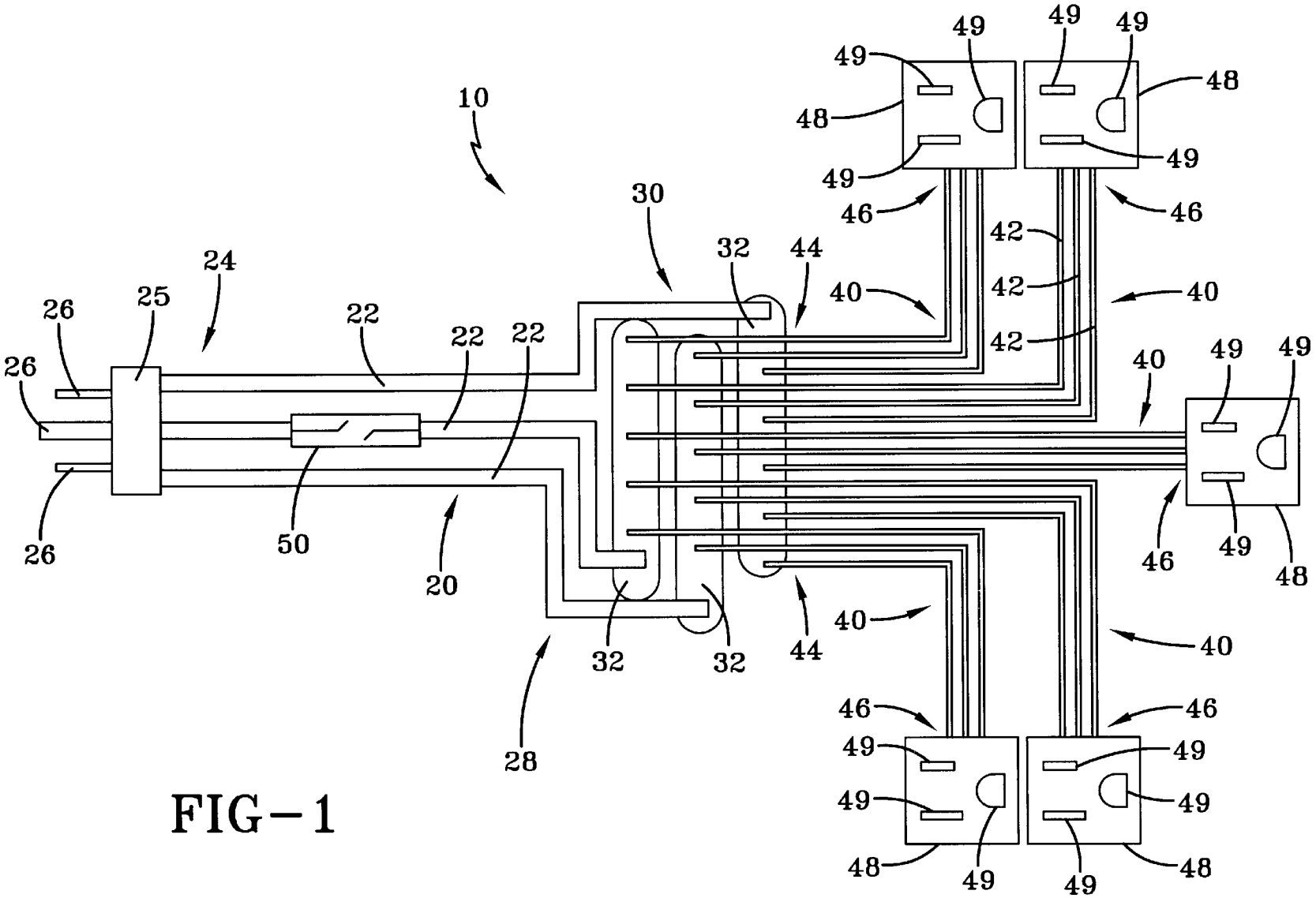
FIG. 1 is a schematic view of one embodiment of an electrical distribution system of the present invention.
Figure 2:
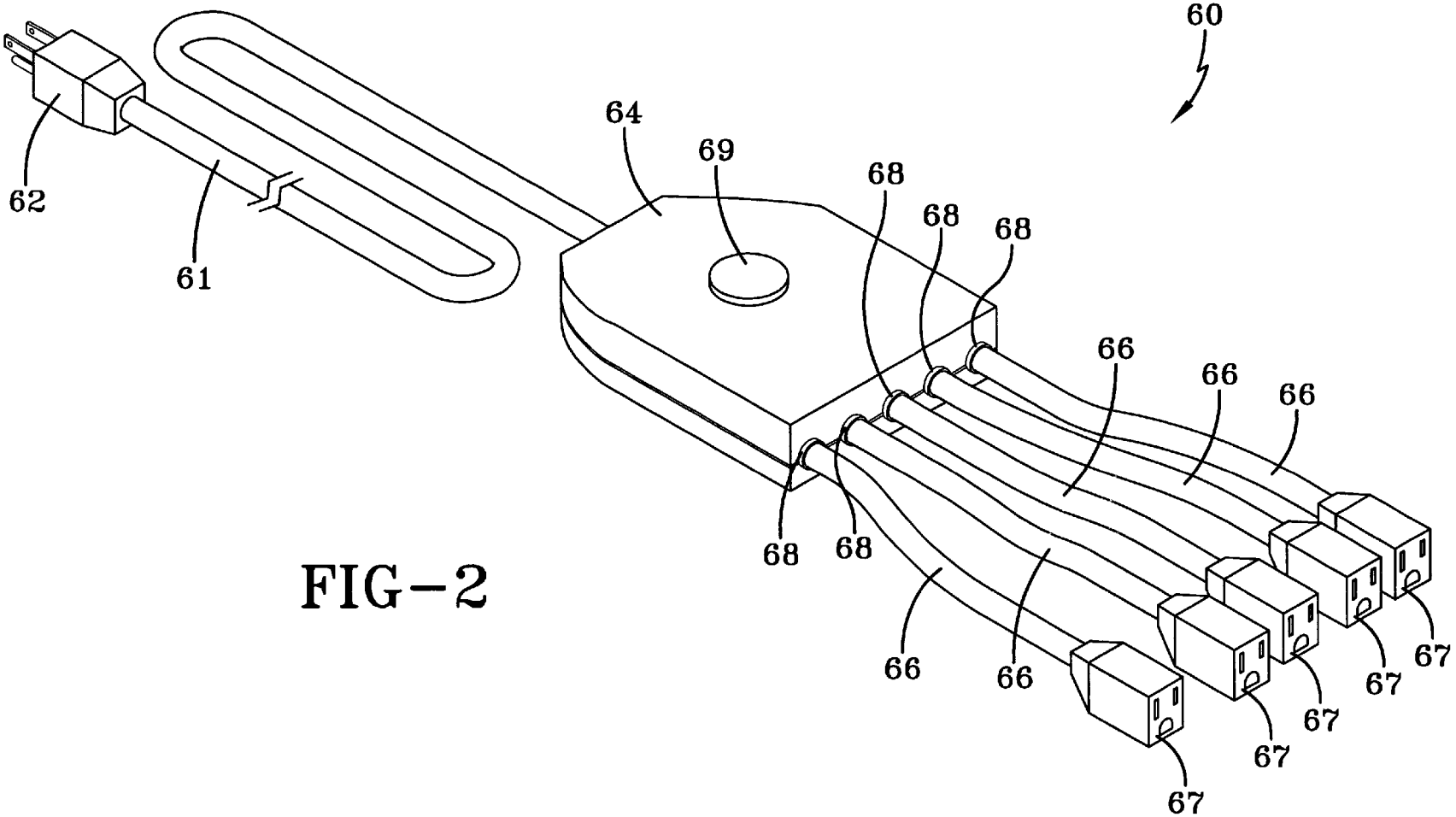
FIG. 2 is a perspective view of one embodiment of a power strip of the present invention.
Figure 3:
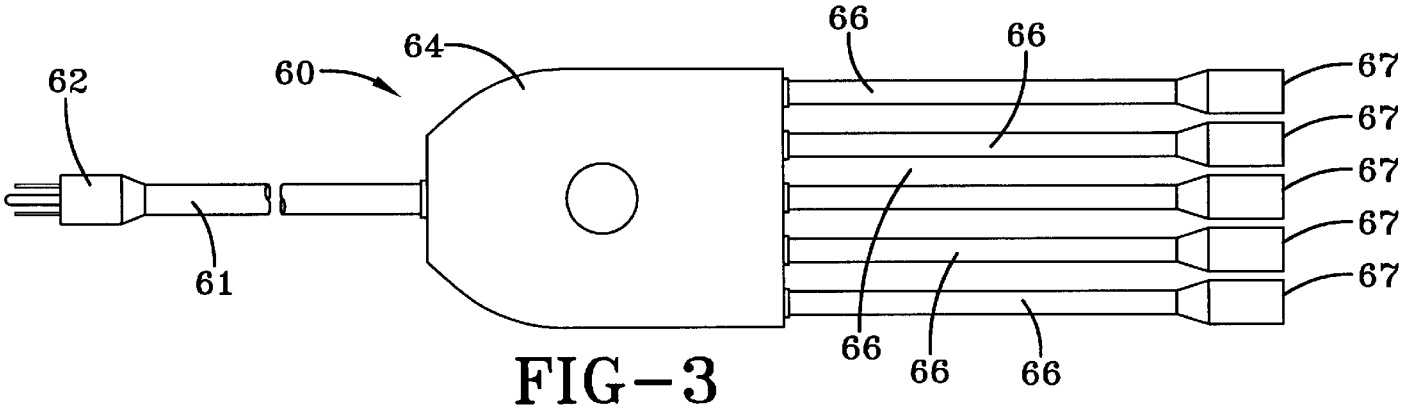
FIG. 3 is a top plan view of the power strip shown in FIG. 2.
Figure 4:
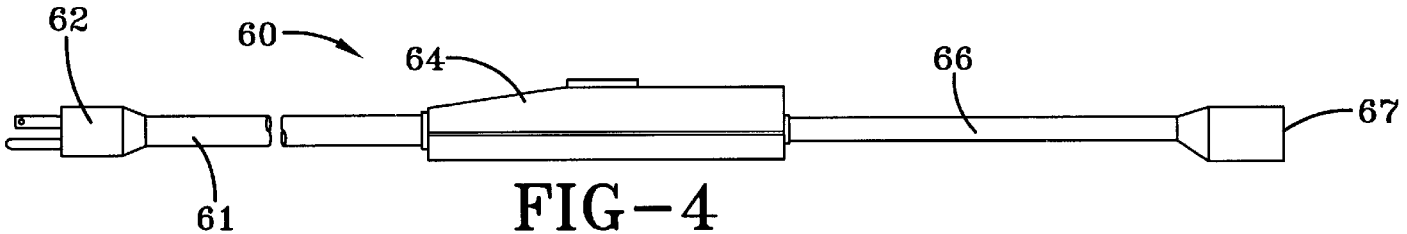
FIG. 4 is a side elevation view of the power strip shown in FIG. 2.
Figure 5:
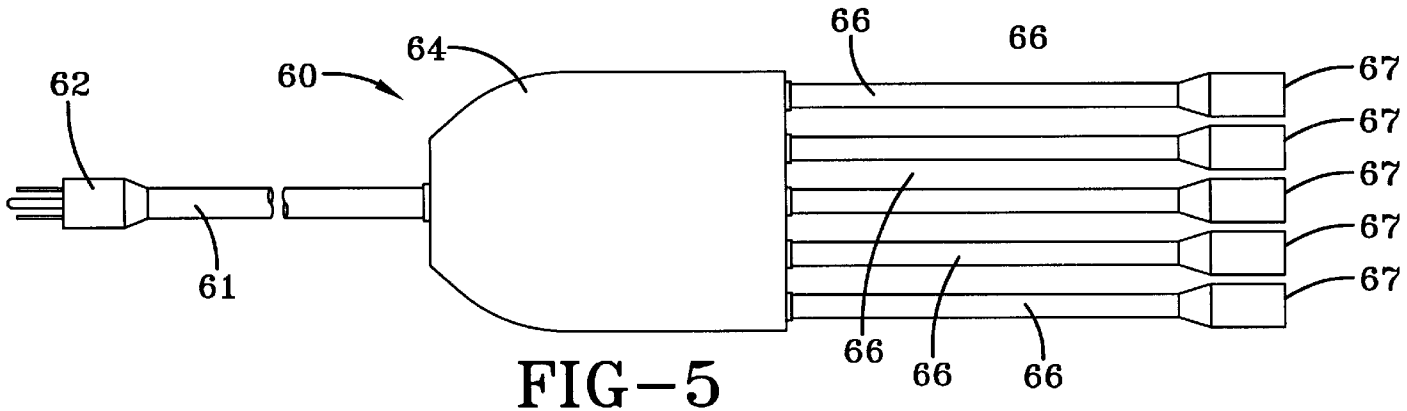
FIG. 5 is a bottom plan view of the power strip shown in FIG. 2.

FIG. 1 shows one example of a system 10 of the present invention. The system 10 is comprised of a cable 20, at least one bus system 30, and at least one cable 40. The cable 20 is adapted to be in electrical communication with the at least one cable 40 via the bus system 30.

The cable 20 is preferably adapted to receive an input of electricity. In this example, the cable 20 is comprised of at least one conductor 22, e.g., a positive conductor, a neutral conductor, and a ground conductor. A conductor 22 may be comprised of any conductive material. For example, a conductor 22 may be comprised of copper, aluminum, or any other similar, suitable, or conventional conductive metal. The distal end 24 of the cable 20 may be connected to an electrical connector 25. In this example, the electrical connector 25 is a plug having at least one male connecting portion 26. The electrical connector 25 is preferably adapted to be plugged into a source of electricity, e.g., an electrical outlet in a household or workplace.

The cable 20 is adapted to place the bus system 30 in electrical communication with the source of electricity. A proximal end 28 of the cable 20 is connected to the bus system 30. The bus system 30 is comprised of at least one bus 32, e.g., a positive bus, a neutral bus, and a ground bus. Each bus 32 may be comprised of any conductive material that may be placed in electrical communication with a conductor 22. For example, a bus 32 may be comprised of copper, aluminum, or any other similar, suitable, or conventional conductive metal. Each conductor 22 is connected to a respective bus 32. A conductor 22 may be connected to a bus 32 by any suitable means. For example, a conductor 22 may be directly connected to a bus 32 by soldering, clamping, wire wrapping, press fitting, mass termination insulation displacement connection, or any other similar, suitable, or conventional means for connecting a conductor to a bus. In some embodiments of the present invention, a conductor 22 may also be indirectly connected to a bus 32 such as by an electrical connector or any other similar, suitable, or conventional means for indirectly connecting a conductor to a bus.

Each cable 40 is also adapted to be in electrical communication with the bus system 30. In this example, each cable 40 is comprised of at least one conductor 42, e.g., a positive conductor, a neutral conductor, and a ground conductor. A proximal end 44 of each cable 40 is connected to the bus system 30. Similar to the other cable 20, each conductor 42 is connected to a respective bus 32. As noted above, a conductor 42 may be directly or indirectly connected to a bus 32 by any suitable means.

In this embodiment, electricity such as power or other types of electrical signals may be transferred to multiple locations by the cables 40. A distal end 46 of each cable 40 may be terminated in an electrical connector 48. In this example, the electrical connector 48 is a socket having at least one female connecting portion 49. The electrical connector 48 is preferably adapted to receive a plug of a device that needs the electricity.

At least one switch 50 may be connected to the cable 20 in order to allow a user to turn on and shut off a supply of electricity to the bus system 30. For example, a switch may be connected to a positive or neutral conductor 22 of the cable 20. Such an embodiment would enable the power to each cable 40 to be shut off.

Figure 8:
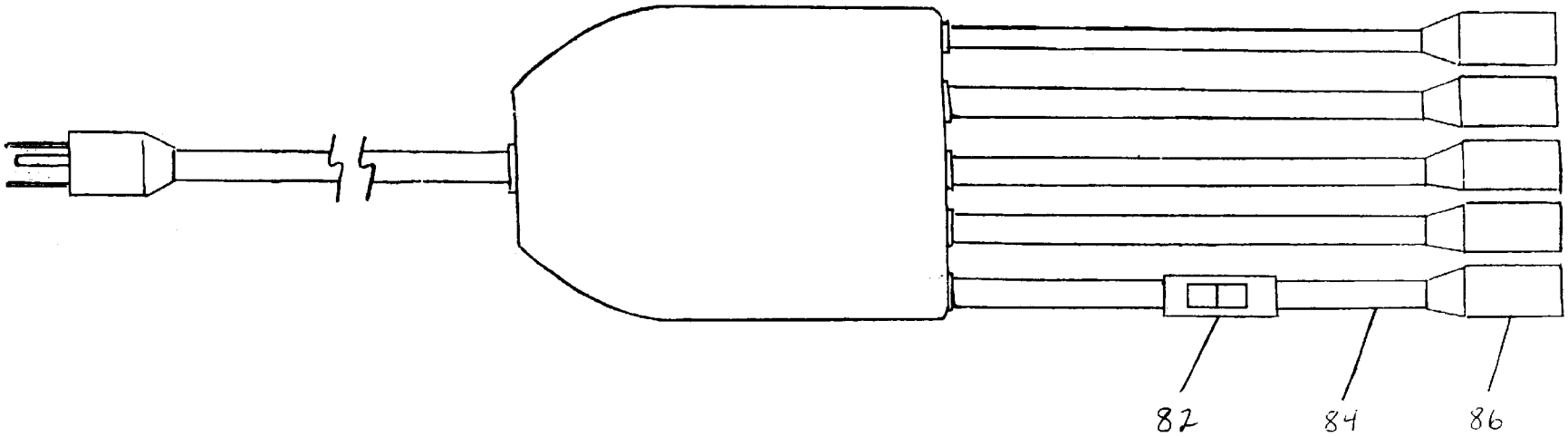
FIG. 8 is a top plan view of one embodiment of a power strip of the present invention that includes an output regulation device.

A switch may also be connected to a respective cable 40 such that a supply of electricity from the bus system 30 may be turned on and off to the respective cable 40. For example, a switch may be connected to a positive or neutral conductor 42 of a cable 40. This embodiment would enable the power to an individual cable 40 to be turned off by a user. For instance, FIG. 8 shows an embodiment in which a switch 82 is connected to an output cable 84 for regulating the output of the connector 86.

In addition or alternatively to the switches discussed above, other components may be implemented in the system 10. For example, other electrical devices or circuits including, but not limited to, fuses, circuit breakers, circuit protectors, and uninterruptible power supply circuits may be employed in a manner similar to the aforementioned switches. Any of these devices may be connected to the cable 20 and/or at least one cable 40. Fuses, circuit breakers, circuit protectors, power filters, power conditioners, and/or uninterruptible power supply circuits may be used to regulate a flow of electricity to and/or from the bus system 30 in response to an overcurrent. Regulating the flow of electricity may include, but is not limited to, turning off the flow of electricity or adjusting the flow of electricity to an acceptable level.

In the example of FIG. 1, the connector 25 is a plug having three male connecting portions 26, and the connectors 48 are sockets having three respective female connecting portions 49. However, other embodiments of the present invention may implement different types of the connectors to suit a particular application. For instance, the connector 25 may be replaced with a connector that includes female connecting portions, and the connectors 48 may be replaced with connectors that include male connecting portions. Additionally, the number of connecting portions of each connector may be fewer or more than three to suit a particular application. For instance, if there is no ground connection, connectors having only two connecting portions may be used. Furthermore, it should be recognized that any of a wide variety of connectors may be utilized in the present invention to suit a particular application. Examples of types of connectors include, but are not limited to, power connectors, circular or cylindrical (shell) connectors (e.g., for multiple conductors), single-piece printed circuit (PC) or card-edge connectors, two piece plug and receptacle PC board connectors, rectangular multipin connectors (e.g., rack and panel connectors), coaxial or radio-frequency connectors for single, twin, or triple conductors, and various other similar, suitable, or conventional electrical connectors that are now known or may be later developed.

The cable 20 and the cables 40 may also be selected to suit a particular application. Any type of cable may be utilized in the present invention. Examples of types of cable include, but are not limited to, insulation cables, flat cables, ribbon cables, bonded ribbon cables, woven-ribbon cables, shielded flat cables, twisted-component cables, coaxial cables, fiberoptic cable, and other similar, suitable, or conventional types of cable that are now known or may be later developed. If desired for a particular application, the cable may have insulation, a jacket, and/or a shield. However, it should be recognized that insulation, jackets, and shields are optional. In addition, the present invention is not limited to using cables to transfer the electricity. Any similar, suitable, or conventional conductive item that is now known or may be later developed may be used to transfer the electricity. For example, electrical wires, electrical cords, isolated conductors, and conductors that are not insulated may be used in the present invention. The conductive item is preferably flexible such that the respective inlet or outlet, e.g., connector 25 or connector 48, is adjustable. However, it should be recognized that the conductive item may not be flexible in some embodiments of the present invention. The length of each conductive item may be selected to suit a desired application. Furthermore, it should be recognized that the number and gauge of the conductors may be selected depending on the type of electricity that is to be transferred to and from the bus system 30. In the example of FIG. 1, three conductors are used to input a supply of electricity, e.g., 120 volts alternating current (AC), to the bus system 30. However, in other embodiments, fewer than three, e.g., 1 or 2, or more than three conductors may be used to transfer a signal or signals to the bus system 30. Similarly, the number of buses 32 in the bus system 30 may be any number that is suitable for receiving the particular input of electricity or electrical signal.

Optionally, the present invention may include device(s) that may be used to gather the cables 40 and the outlets 48 closer together. For example, a device may extend around the cables 40. In order to bring the cables 40 and the outlets 48 closer together, the device may be moved up closer to the outlets 48. Examples of such a device include, but are not limited to, rings, rubber bands, elastic wraps, twist ties, wire ties, and other similar, suitable, or conventional devices.

The present invention may be utilized to distribute any number, type, phase, frequency, or amplitude of electrical signals. In addition, the present invention may be used for serial or parallel electrical signal transmission, e.g., data transmission.

For example, the present invention may be implemented as a power strip for distributing 120 volts AC. In addition, the present invention may be used to distribute direct current (DC) signals. Furthermore, the present invention may be used to distribute digital and analog signals. It should also be recognized that the present invention may be implemented in devices having multiple bus systems.

FIGS. 2 through 5 illustrate an example of a power strip 60 of the present invention. The power strip 60 may implement any of the optional or preferred features discussed herein. In this example, one end of a power cord 61 is connected to an electrical plug 62. The electrical plug 62 is adapted to be plugged into an electrical outlet to receive a supply of electricity. The other end portion of the power cord 61 preferably extends into a housing 64 through an aperture. The aperture is preferably comprised of an insulating material. However, it should be recognized that the aperture may be lined with a conductive material. A bus system such as the one discussed above is enclosed and mounted inside the housing 64, and it is connected to the end of the power cord 61. In this manner, the bus system is adapted to be in electrical communication with a source of electricity. An end portion of at least one power cord 66 also extends through a respective aperture 68 of the housing 64 and connects to the bus system. As discussed above, the aperture(s) 68 may be comprised of insulating and/or conductive material. The distal end of each power cord 66 is connected to a respective socket 67. As a result, each socket 67 is adapted to provide power. If desired, a switch 69 may be mounted on the housing 64. The switch 69 may be used to perform any desired function such as turning on and off the supply of electricity to the bus system or to any or all of the connectors 67.

Figure 6:
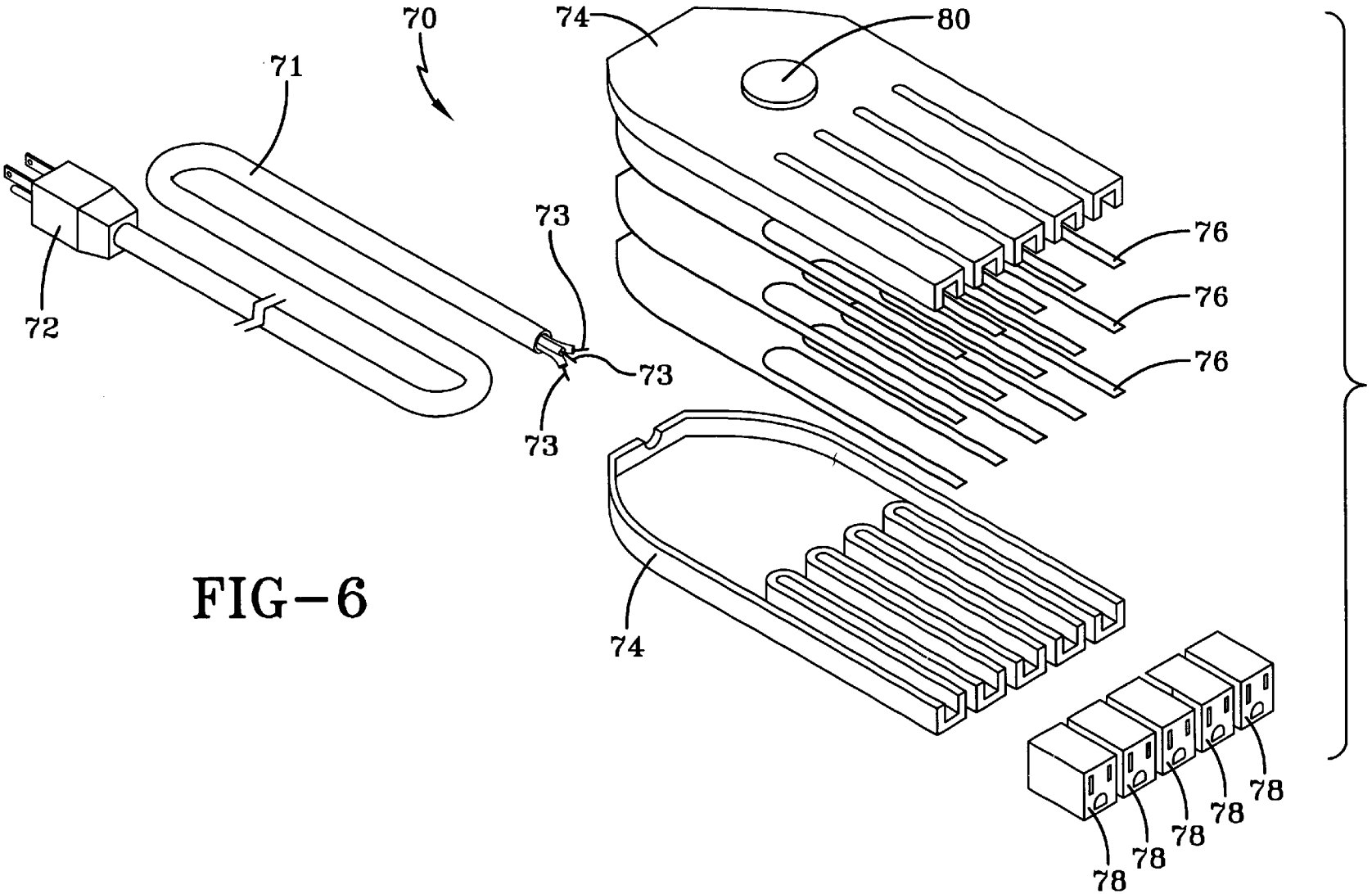
FIG. 6 is a perspective, fragmentary view of another embodiment of a power strip of the present invention.
Figure 7:
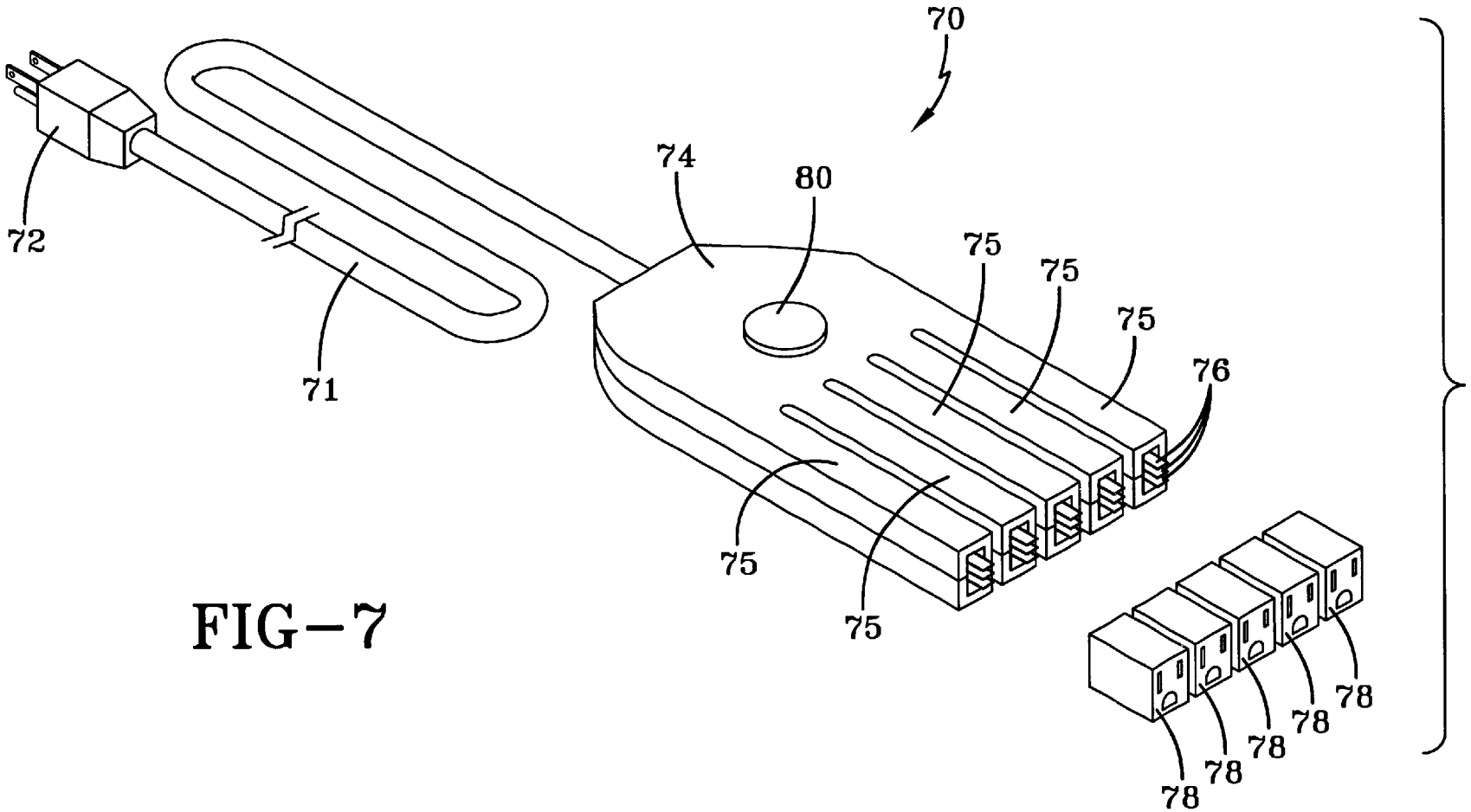
FIG. 7 is another perspective, fragmentary view of the power strip shown in FIG. 6.

FIGS. 6 and 7 illustrate another embodiment of a power strip 70 of the present invention. The power strip 70 may include any of the optional or preferred features described above. The power strip 70 may be used in any desired environment, but it is particularly well adapted for use in industrial or manufacturing environments. In this embodiment, the power strip 70 is preferably made more durable by replacing the outlet power cables with a flexible housing. One end of a power cord 71 is terminated by an electrical plug 72 which is adapted to be plugged into an electrical outlet to receive a supply of electricity. The power cord 71 may be comprised of a plurality of conductors 73. The conductors 73 preferably extend into a housing 74. The housing 74 may be an integral or multi-piece unit. A bus system such as the one discussed above is enclosed in the housing 74. The bus system is comprised of at least one bus 76. Each conductor 73 is preferably connected to a respective bus 76. In this manner, the bus system is adapted to be in electrical communication with a source of electricity. At least one socket 78 substantially abuts the housing 74 and is in electrical communication with the bus system. As a result, each socket 78 is adapted to provide power. If desired, a switch 80 or any other desired electrical device or circuit may be mounted on the housing 74 and placed in electrical communication with the bus system. The switch 80 may be used to perform any desired function such as turning on and off the supply of electricity to the bus system or to any or all of the connectors 78.

The housing 74 has at least one extended portion 75. In this example, the housing 74 has five respective extended portions 75. The respective buses 76 preferably extend through each extended portion 75 and are in electrical communication with the respective outlets 78. If desired, the housing 74 may include insert moulding to encase the bus system and electrically isolate the buses 76. The insert moulding may also be used to increase the durability of the power strip 70. The insert moulding may be comprised of any desired insulating material.

The housing 74 and the respective buses 76 are preferably flexible components in order to enable the position of each outlet 78 to be adjusted. The degree of flexibility may be selected to suit the desired use of the product. The housing 74 may be comprised of any desired flexible material(s). For example, the housing 14 may be comprised of a flexible plastic, thermoplastic, or polymer material including, but not limited to, rubber, foamed plastics, and other similar, suitable, or conventional materials. The bus system may also be comprised of any desired flexible material(s) including, but not limited to, flexible metals and other similar, suitable, or conventional materials. However, it should be recognized that the housing 74 and the bus system may be relatively inflexible, e.g., rigid, in alternative embodiments of the present invention. For instance, the housing 74 may be comprised of any desired rigid material such as a rigid plastic, and the bus system may be comprised of any desired rigid material such as a rigid metal.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A power strip comprising:

a first power cord having a proximal end and a distal end, said first power cord adapted to receive an input of electricity;

a second power cord having a proximal end and a distal end;

a third power cord having a proximal end and a distal end; and a bus system directly connected to said proximal end of said first power cord, said proximal end of said second power cord, and said proximal end of said third power cord;

whereby said first power cord is adapted to be in electrical communication with said second power cord and said third power cord.

2. The power strip of claim 1 further comprising a housing substantially enclosing said bus system.

3. The power strip of claim 2 wherein said housing comprises:

a first aperture, said first power cord passing through said first aperture to said bus system;

a second aperture, said second power cord passing through said second aperture to said bus system; and a third aperture, said third power cord passing through said third aperture to said bus system.

4. The power strip of claim 1 further comprising a switch connected to said first power cord, said switch adapted to enable said input of electricity to be shut off to said bus system.

5. The power strip of claim 1 further comprising a switch connected to said second power cord, said switch adapted to enable an output of electricity from said bus system through said second power cord to be shut off.

6. The power strip of claim 1 further comprising a device selected from the group consisting of fuses, circuit breakers, circuit protectors, power filters, power conditioners, and uninterruptible power supply circuits, said device connected to said first power cord, said device adapted to regulate said input of electricity to said bus system in response to an overcurrent.

7. The power strip of claim 1 further comprising a device selected from the group consisting of fuses, circuit breakers, circuit protectors, and uninterruptible power supply circuits, said device connected to said second power cord, said device adapted to regulate an output of electricity from said bus system through said second power cord in response to an overcurrent.

8. The power strip of claim 1 further comprising an electrical connector connected to said distal end of said first power cord, said electrical connector adapted to be placed in electrical communication with an electrical outlet to receive said input of electricity.

9. The power strip of claim 8 wherein said electrical connector is selected from the group consisting of plugs and sockets.

10. The power strip of claim 1 further comprising an electrical connector connected to said distal end of said second power cord, said electrical connector adapted to provide an output of electricity from said second power cord.

11. The power strip of claim 10 wherein said electrical connector is selected from the group consisting of plugs and sockets.

12. The power strip of claim 1 further comprising:

at least one additional power cord having a proximal end and a distal end;

said bus system connected to said proximal end of said at least one additional power cord;

whereby said first power cord is adapted to be in electrical communication with said at least one additional power cord.

13. The power strip of claim 1 wherein:

said first power cord comprises a plurality of conductors;

said second power cord comprises a plurality of conductors;

said third power cord comprises a plurality of conductors; and said bus system comprises a plurality of buses, each of said buses connected to one of said conductors of said first power cord, one of said conductors of said second power cord, and one of said conductors of said third power cord.

14. The power strip of claim 1 wherein said input of electricity is selected from the group consisting of alternating current and direct current.

15. An electrical strip comprising:

a first cable having a first conductor and a second conductor, said first cable adapted to receive an input of electricity;

a second cable having a third conductor and a fourth conductor;

a first bus connected directly to a proximal end of said first conductor of said first cable and to a proximal end of said third conductor of said second cable; and a second bus connected directly to a proximal end of said second conductor of said first cable and to a proximal end of said fourth conductor of said second cable;

whereby said first cable is adapted to be in electrical communication with said second cable.

16. The electrical strip of claim 15 further comprising:

at least one additional cable having a plurality of conductors, a proximal end of one of said conductors of said at least one additional cable connected directly to said first bus, a proximal end of another one of said conductors of said at least one additional cable connected directly to said second bus;

whereby said first cable is adapted to be in electrical communication with said at least one additional cable.

17. The electrical strip of claim 15 wherein said first cable has an additional conductor and said second cable has an additional conductor, said electrical strip further comprising:

a third bus connected directly to a proximal end of said additional conductor of said first cable and to a proximal end of said additional conductor of said second cable.

18. A power strip comprising:

an input cable comprising a positive conductor, a neutral conductor, and a ground conductor, said first cable adapted to receive an input of electricity;

at least one output cable comprising a respective positive conductor, a respective neutral conductor, and a respective ground conductor;

a housing having a plurality of apertures, each of said input cable and said at least one output cable passing through a respective one of said apertures;

a positive bus enclosed substantially within said housing, said positive bus connected to said positive conductor of said input cable and said respective positive conductor of said at least one output cable;

a neutral bus enclosed substantially within said housing, said neutral bus connected to said neutral conductor of said input cable and said respective neutral conductor of said at least one output cable; and a ground bus enclosed substantially within said housing, said ground bus connected to said ground conductor of said input cable and said respective ground conductor of said at least one output cable;

whereby said input cable is adapted to be in electrical communication with said at least one output cable.

19. The power strip of claim 18 further comprising a switch mounted on said housing and connected to said input cable, said switch adapted to enable said input of electricity to be shut off to said positive bus.

20. The power strip of claim 19 further comprising:

a plug connected to a distal end of said input cable, said plug adapted to be placed in electrical communication with an electrical outlet to receive said input of electricity; and at least one socket such that a respective one of said at least one socket is connected to a respective distal end of a respective one of said at least one output cable, said respective one of said at least one socket adapted to provide a respective output of electricity from said respective one of said at least one output cable.

21. A power strip comprising: a power cord adapted to receive an input of electricity; a bus system in electrical communication with said power cord, said bus system adapted to be flexed; a housing substantially enclosing said bus system, said housing adapted to be flexed; and an electrical connector substantially abutting said housing and in electrical communication with said bus.

* * * * *

UNITED STATES PATENT AND TRADEMARK OFFICE
Certificate

Patent No. 6,486,407 B1 Patented: November 26, 2002

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Christopher L. Hawker, Columbus, OH; Steven A. Sauer, Columbus, OH; and Patrick J. Bertke, Columbus, OH.

Signed and Sealed this Sixth Day of September 2005.

DEAN A. REICHARD
*Supervisory Patent Examiner*
Art Unit 2831